US006352154B1

(12) United States Patent
Miura

(10) Patent No.: US 6,352,154 B1
(45) Date of Patent: Mar. 5, 2002

(54) GOLF CLUB CARRYING RACK UNIT

(76) Inventor: Atsushi Miura, 79 Statesman Square, Toronto, Ontario (CA), M1S 4H7

( * ) Notice: Subject to any disclaimer, the term of this patent is extended or adjusted under 35 U.S.C. 154(b) by 0 days.

(21) Appl. No.: 09/639,504

(22) Filed: Aug. 17, 2000

(51) Int. Cl.[7] ..... A63B 55/00
(52) U.S. Cl. ..... 206/315.6; 206/315.3
(58) Field of Search ..... 206/315.6, 315.2, 206/315.3, 315.4

(56) References Cited

U.S. PATENT DOCUMENTS 2,307,350 A * 1/1943 Anderson ..... 206/44
4,836,565 A * 6/1989 Catalo ..... 280/37
4,905,827 A * 3/1990 Kim ..... 206/315.3
5,333,731 A * 8/1994 McCuaig ..... 206/315.6
5,544,734 A * 8/1996 Hong ..... 206/315.3

* cited by examiner

*Primary Examiner*—Nathan J. Newhouse
*Assistant Examiner*—Lien Ngo

(57) ABSTRACT

The present invention relates to a golf club carrying rack unit to protect golf clubs from damage due to the collision of the golf club heads when transporting them or when withdrawing and returning them to the carrying rack, by the use of a golf club head retaining means and a golf club shaft retaining means. This organizing feature facilitates the easy selection of any club.

2 Claims, 20 Drawing Sheets

GOLF CLUB CARRYING RACK UNIT

FIELD OF THE INVENTION

This invention relates to golf club carrying equipment.

BACKGROUND OF INVENTION

The common golf club carrying equipment is a simple top open bag. There are two main designs of golf bags in the market. Some have the top opening divided into two or three sections and others have tubes into which the golf club shafts are inserted. There are a number of common features of these known bags. Since the golf clubs are not in a fixed position, the golf club heads hit each other when being carried in the bag or when being withdrawn and returned to the bag. These collisions cause scratches and nicks on the golf club heads, especially the club face surface.

Because of the loose containment of the clubs if the golf bag is over-tilted or up ended, e.g., extracting the golf bag from a car trunk much inconvenience and damages can occur as the clubs slide out and hit a hard surface.

Another inconvenience occurs when traveling by plane, ship or train to be accepted as baggage open top golf bags must be closed either by a top or enclosed entirely in another bag. And again, the unsecured clubs must endure the rigors of baggage handling.

Since there is no fixed arrangement of clubs, there is difficulty readily finding the desired clubs, especially the shorter golf clubs buried under the longer ones.

SUMMARY OF THE INVENTION

The present invention provides a golf club carrying rack unit with each golf club held in position and arranged in order. The golf club carrying rack also provides the security of all golf clubs by means of entire enclosure and locks. The subject invention includes a golf club head retaining means and golf club shaft retaining means installed on the main frame. The golf club head retaining means restricts the rotation of a golf club head around the golf club shaft axis and the upwards movement of a golf club along the golf club shaft axis. The golf club shaft retaining means restricts the radial movement of a golf club shaft around the golf club shaft axis. These two retaining means keep the designated position of each golf club on a main frame, organize the layout and prevent the collision of golf club heads.

BRIEF DESCRIPTION OF THE DRAWINGS

The invention will now be described, by way of example only, with reference to the accompanying drawings, in which.

DETAILED DESCRIPTION OF THE PREFERRED EMBODIMENT

Figure 1:
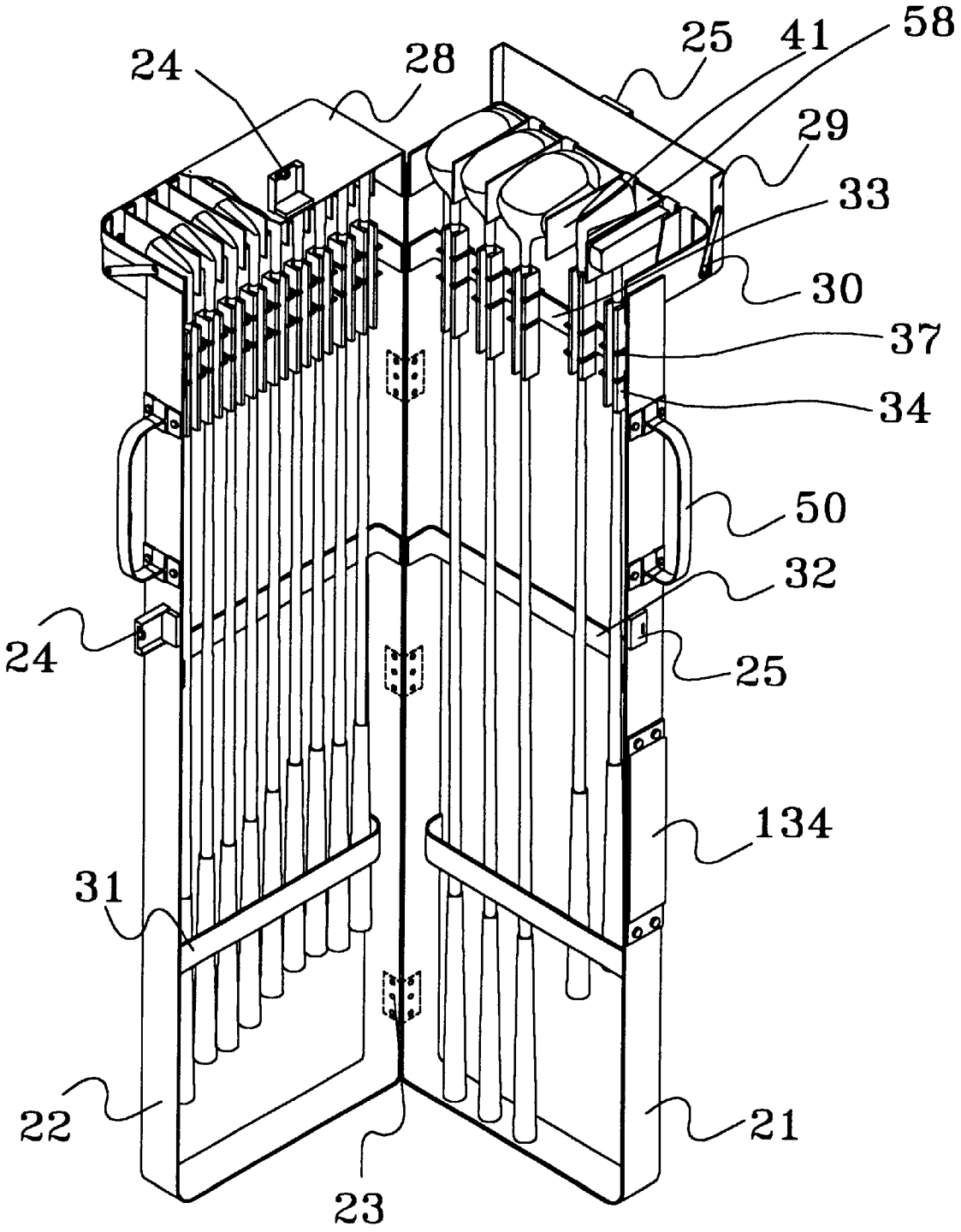
FIG. 1 is a perspective view of the first example of the golf club carrying rack of the subject invention.

The preferred embodiments of the golf club carrying rack of the subject invention will reference to the figure wherein like numbers refer to like parts.

Referring first to FIGS. 1, 2, 3, 4, 5, 6, 7, 8, 9, 10, 11, 12, 13, 14 and 15, in these particular embodiment main frames 21 and 22 are substantially symmetrical and joined with hinges 23. The main frames 21 and 22 are opened when selecting a golf club and closed and secured with locks 24 and 25 when the rack is carried. Hinges 23 are installed on the side of frames 21 and 22 in FIG. 1. However hinges 23 can be installed at the bottom of frames 21 and 22 for a vertical open rack. The tops of each frames 21 and 22 are equipped with caps 28 and 29 joined to the frames with lever hinges 30. When caps 28 and 29 are closed the top of the golf club head touches to them and the upwards movement of golf clubs is restricted. The golf clubs can also be accessed from the top with frames 21 and 22 closed.

Figure 21:
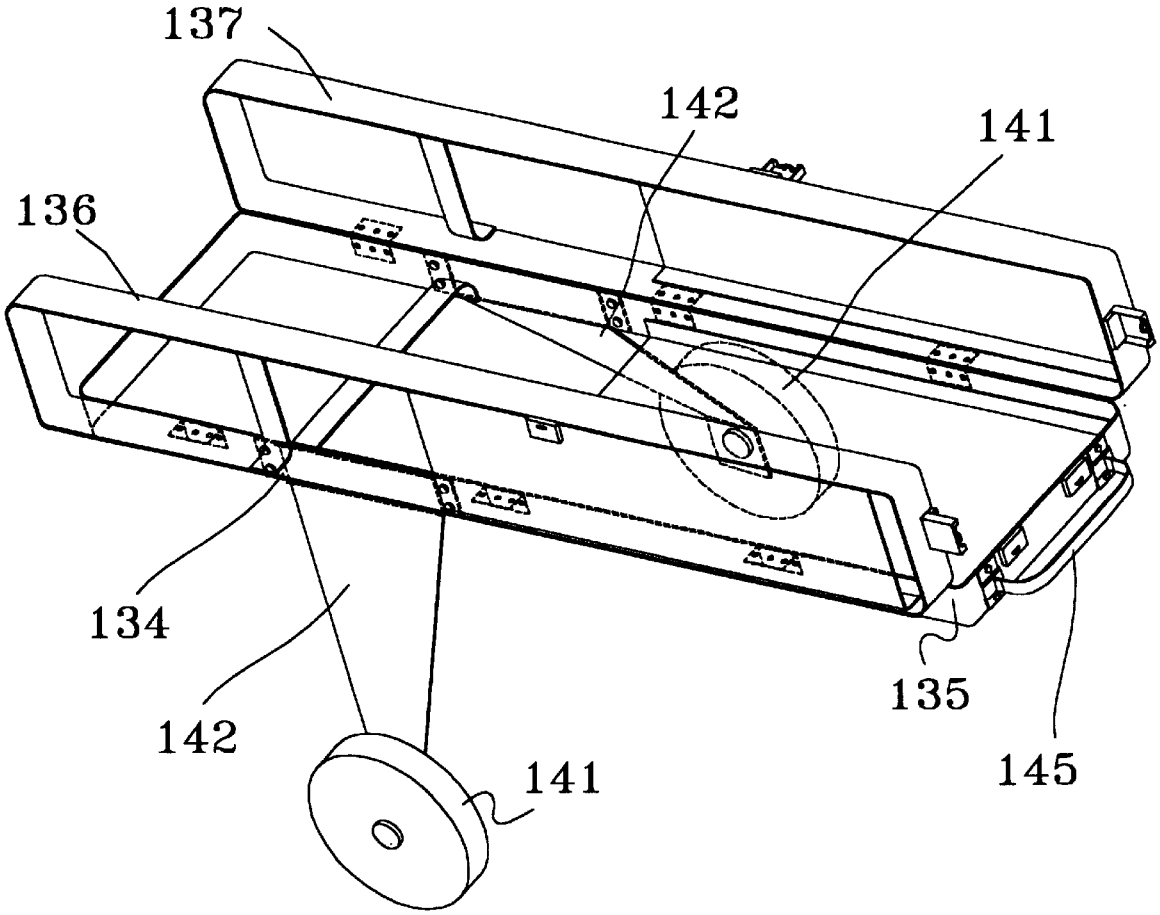
FIG. 21 illustrates the fourth example of the golf club carrying rack with wheels.

The Carrying strap handles 50 on each frame 21 and 22 are made of cloth or leather and come together when frames 21 and 22 are closed and locked. A long shoulder strap may be used instead of the carrying handles 50. Similar wheels as shown in FIG. 21 may be installed with bracket 134.

Golf club shaft retaining means 34 is installed with shaft retaining means bracket 37 on guide rail 33 which is a horizontal flat bar on frames 21 and 22. Referring to FIGS. 5, 6, 7 and 8, the function of golf club shaft retaining means 34 is to restrict the radial movement of the golf club shaft around the golf club shaft axis. Golf club shaft retaining means 34 is a block with generally rectangular section. Running down its length is a vertical shaft passage slit 35, which is slightly wider than the smallest diameter of a golf club shaft where the shaft meets the club head. At the top of the block there is a downward tapered cylindrical hole 36. The diameter of the bottom of tapered cylindrical hole 36 is the same as the width of shaft passage slit 35. When a golf club shaft goes through shaft passage slit 35 and is lowered, the larger diameter golf club head joint 49(49 is not part of this invention.) hits the wall of tapered cylindrical hole 36; therefore, the golf club shaft cannot move out through shaft passage slit 35 unless the golf club is lifted up and golf club head joint 49 is moved out of tapered cylindrical hole 36. The movement of the grip end of the golf club is restricted by horizontal bar 31 and the middle portion of the club is secured by horizontal bar 32 for additional security.

Figure 2:
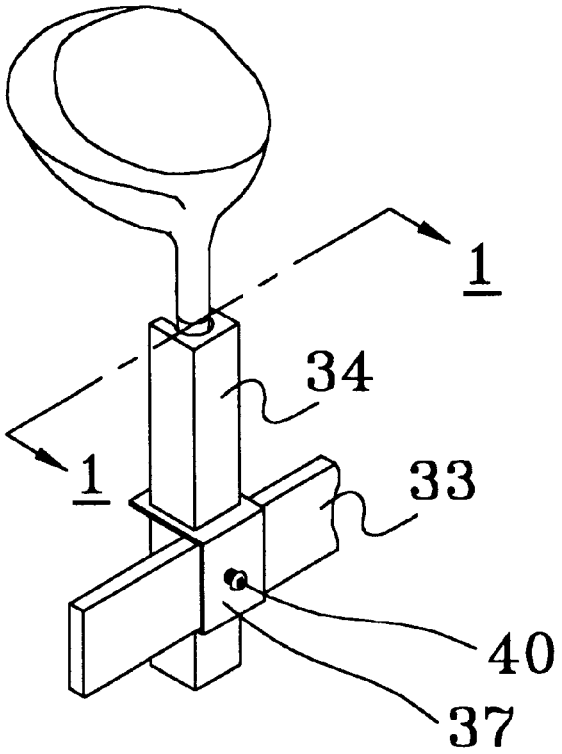
FIG. 2 is a perspective back view of the first example of golf club shaft retaining means completed with a bracket, a guide rail and a golf club inserted in position.
Figure 3:
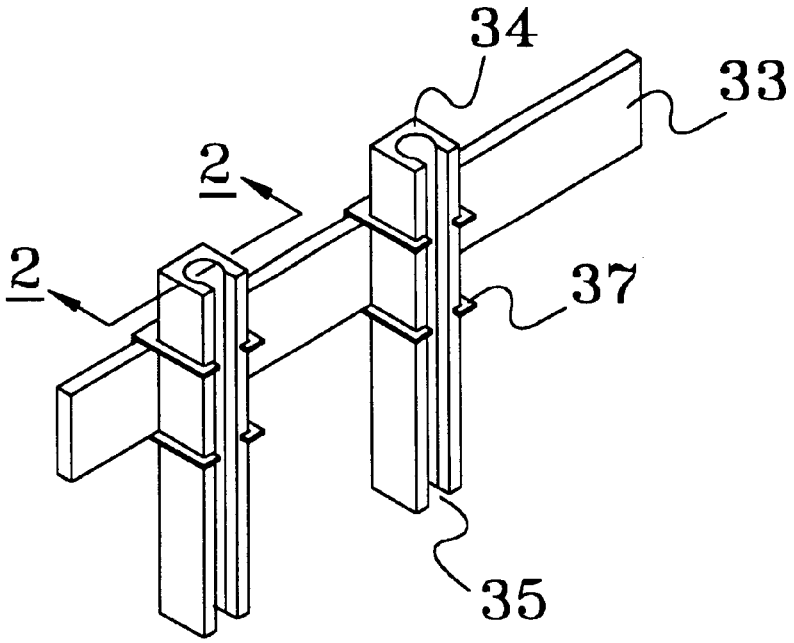
FIG. 3 is a perspective view showing the front view of the golf club shaft retaining means completed with a bracket.
Figure 4:
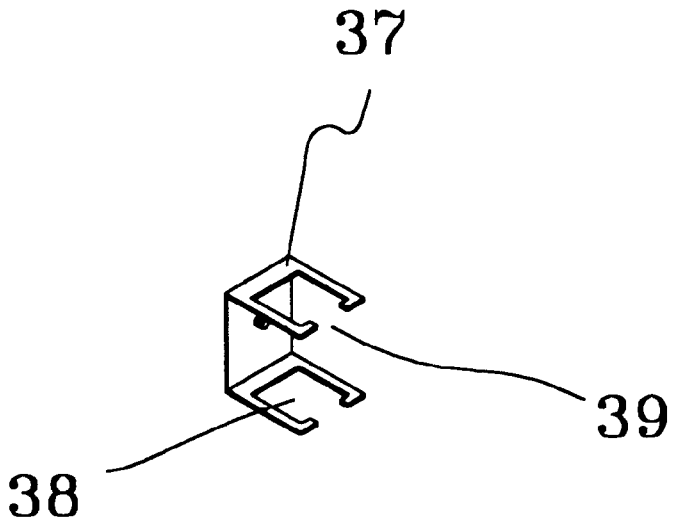
FIG. 4 illustrates the bracket for the golf club shaft retaining means shown in FIG. 2.
Figure 5:
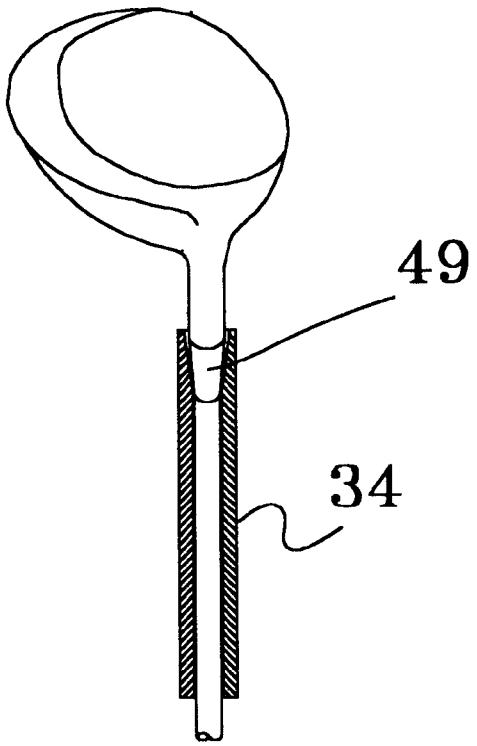
FIG. 5 is a sectional view 1—1 of the golf club shaft retaining means shown in FIG. 2.
Figure 6:
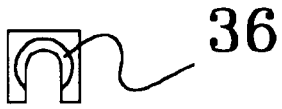
FIG. 6 illustrates the top view of the golf club shaft retaining means shown in FIG. 7.
Figure 7:
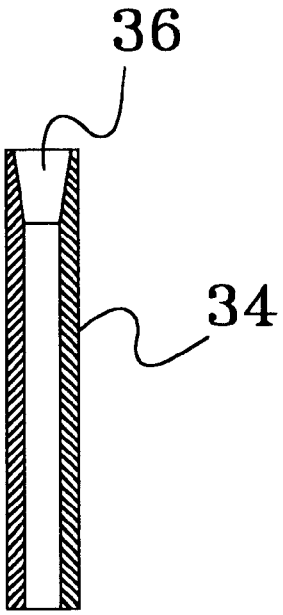
FIG. 7 is a sectional view 2—2 of the golf club shaft retaining means shown in FIG. 3.
Figure 8:
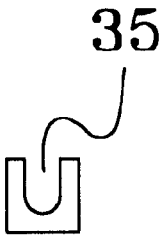
FIG. 8 is a bottom view of the golf club shaft retaining means shown in FIG. 7.

Referring to FIGS. 2, 3, and 4, the top and bottom flanges of golf club shaft retaining means bracket 37 have slightly larger cutouts 38 than the exterior of the sidewise cross section of golf club shaft retaining means 34. Shaft passage opening 39 is equal or slightly wider than the shaft passage slit 35 on golf club shaft retaining means 34. When golf club shaft retaining means 34 is inserted into cutouts 38 of golf club shaft retaining means bracket 37, the horizontal and vertical positions of golf shaft retaining means 34 on guide rail 33 will be adjusted with set screw 40. When golf club shaft retaining means 34 is raised so that the top of the contained golf club head touches the closed caps 28 or 29 and set screw 40 is tightened, the golf club's movement is restricted except for the rotation around golf club shaft axis.

Figure 9:
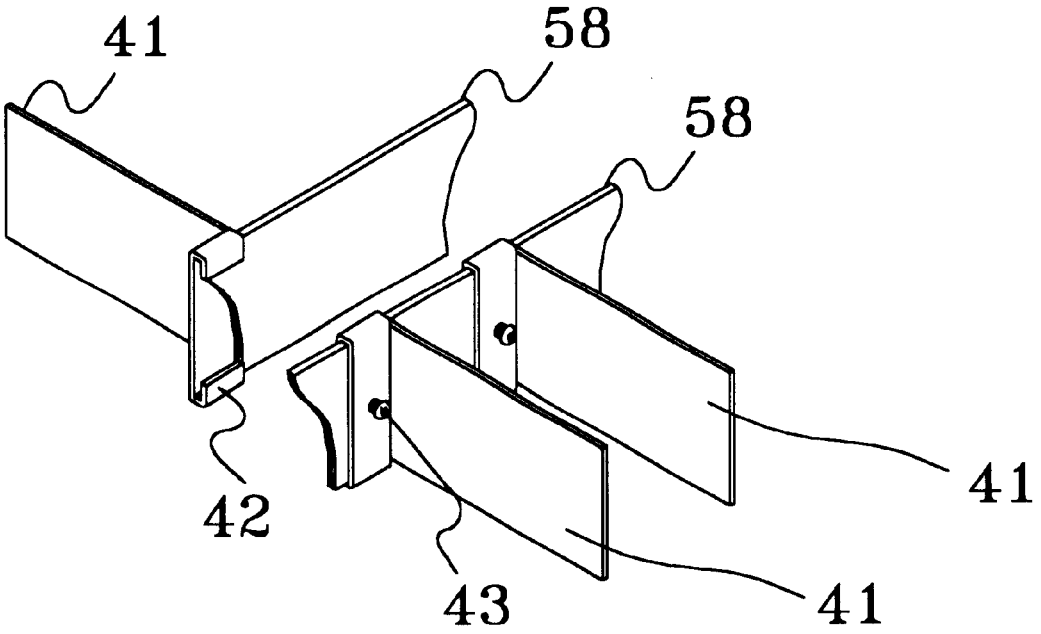
FIG. 9 is a perspective view of the first example of the golf club head retaining means with space divider.

Referring to FIG. 9, space divider 41 is a plate that has a right angled C-shaped channel 42. C-shaped channel 42 is coupled with and slides along the length of a flat bar guide rail 58. The golf club head retaining means in this embodiment is established by the space created between two of space dividers 41 and cap 28 or 29 or by the space created between a space divider 41 and frame 21 or 22 and cap 28 or 29, for the golf club adjacent to the frame. The space created between two of space dividers 41 restricts the rotation of a golf club head around the golf club shaft axis. Caps 28 and 29 restrict the golf club upwards movement along the golf club shaft axis. Thus the golf club movement is restricted by adjusting both the height of golf club shaft retaining means 34 and the space between two space dividers 41.

Figure 10:
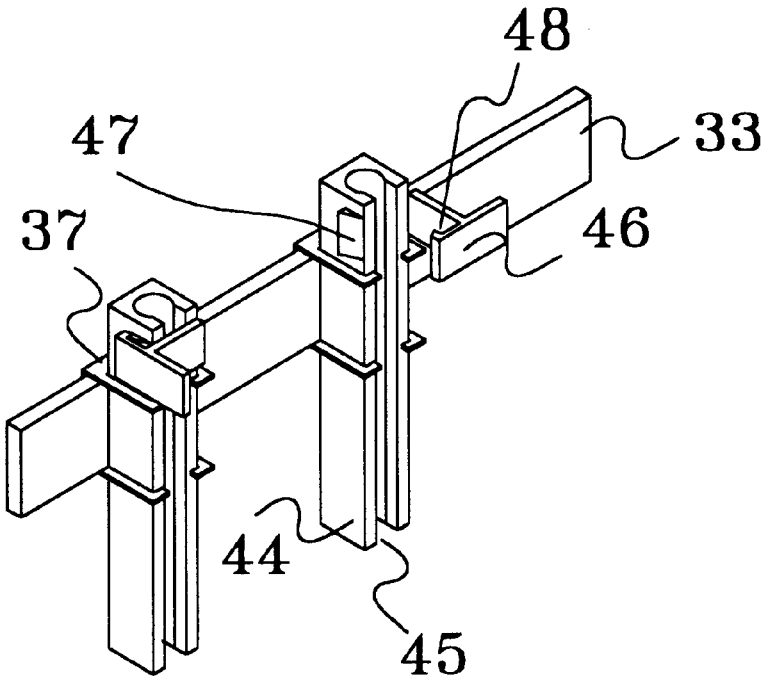
FIG. 10 is a perspective view of the second example of the golf club shaft retaining means with a gate in front.

FIG. 10 shows the modified golf club shaft retaining means 44 with a gate 46 across shaft passage slit 45 for additional security. Gate 46 is hinged on golf club retaining means 44. When gate 44 is closed, ramp hook 47 engages latch 48 on gate 46. When the opposite side of latch 48 on gate 46 is pressed counter clockwise around the hinge axis, looking from the top, gate 46 disengages. The material of the gate will be a flexible material like plastic to make engagement or disengagement possible.

Figure 11:
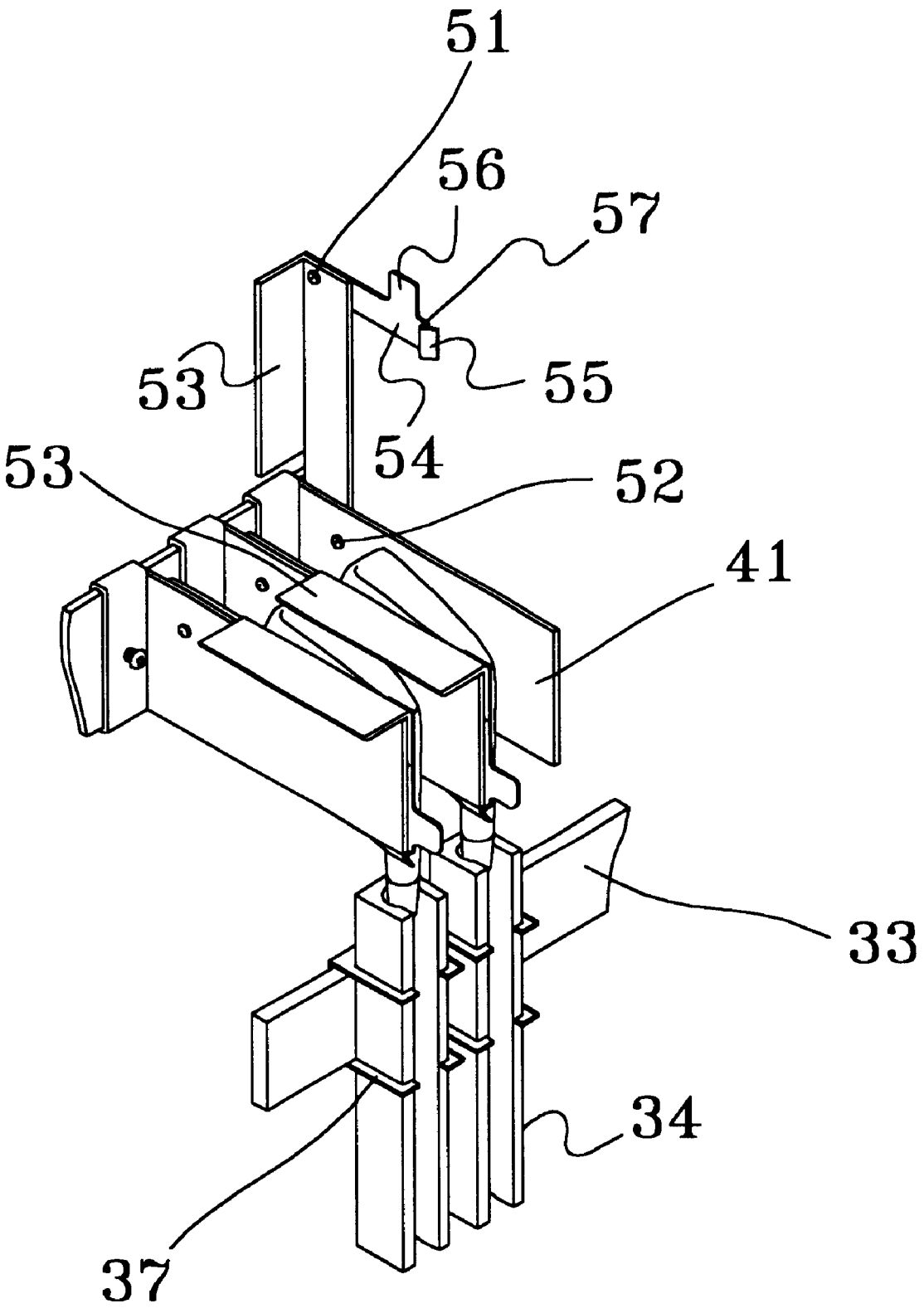
FIG. 11 is a perspective view of the second example of the golf club head retaining means with a gate at the top of the space divider.

FIG. 11 illustrates said space dividers 41 with gate 53 to restrict the upwards movement of a golf club. Gate 53 is a piece of angle and installed on space divider 41 with a pin 52. A thin sheet metal spring hook 54 is installed on gate 53 with rivet 51. When gate 53 is closed rotating around pin 52, ramp 55 at the tip of thin sheet metal spring hook 54 hits the top of space divider 41 and is pushed away and slides down the surface of the space divider 41, then notch 57 engages with the lower edge of the space divider 41. To open gate 53, tongue 56 is pushed away from space divider 41 to disengage the notch 57 and then gate 53 is lifted.

Figure 12:
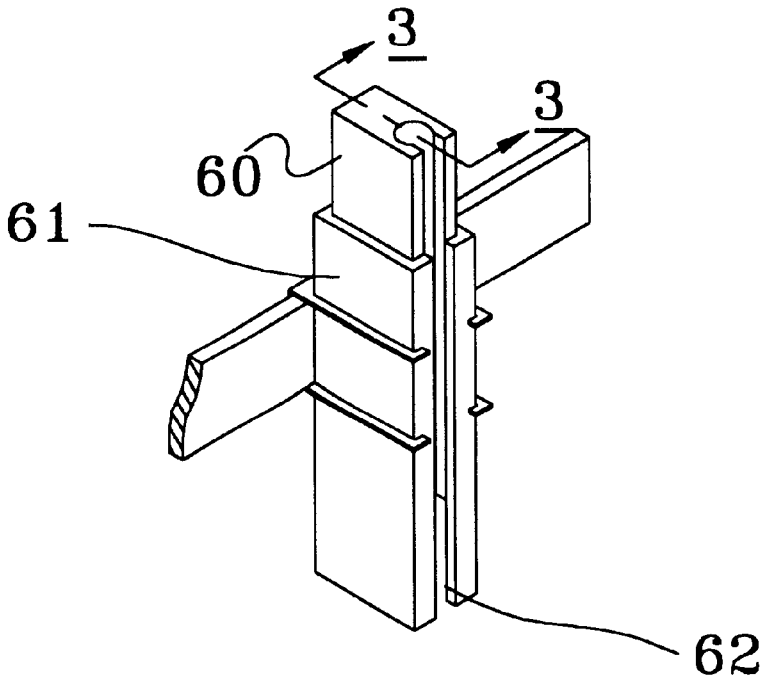
FIG. 12 illustrates the third example of the golf club shaft retaining means which is in a outer cell and pushed upwards with spring.
Figure 13:
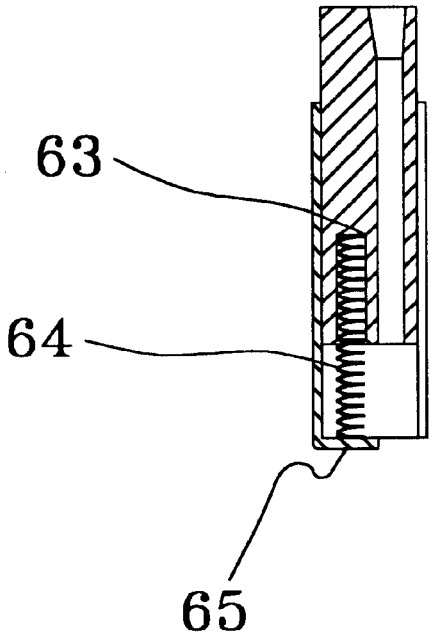
FIG. 13 is a sectional view 3—3 of FIG. 12.

Referring to FIGS. 12 and 13, this particular embodiment of the golf club shaft retaining means consists of a golf club shaft retaining means 60, an outer cell 61 and a spring 64. Golf club shaft retaining means 60 is the same as golf club shaft retaining means 34 shown in FIGS. 1, 2 and 3 except for the spring hole 63. The internal cross sectional dimension of outer cell 61 is slightly bigger than the outside cross sectional dimension of golf club shaft retaining means 60. Golf club shaft retaining means 60, when inserted in outer cell 61, can move up and down. There is a shaft passage 62 in front of outer cell 61. Spring 64, inserted between spring hole 63 and spring seat 65, pushes up golf club shaft retaining means 60. This golf shaft retaining means is used for a frame without a cap at the top. The height of outer cell 61 is adjusted so that the spring force presses the golf club head against the top of the frame casing when a golf club is stored. To withdraw a golf club, first push the golf club shaft retaining means 60 downwards to clear the club head from the top frame casing, hold its position and then lift the golf club up slightly and pass the golf club shaft through passage slit 62. A mechanism to stop golf club shaft retaining means 60 from popping out of outer cell 61 by spring force is not shown here to make the sketch simpler.

Figure 14:
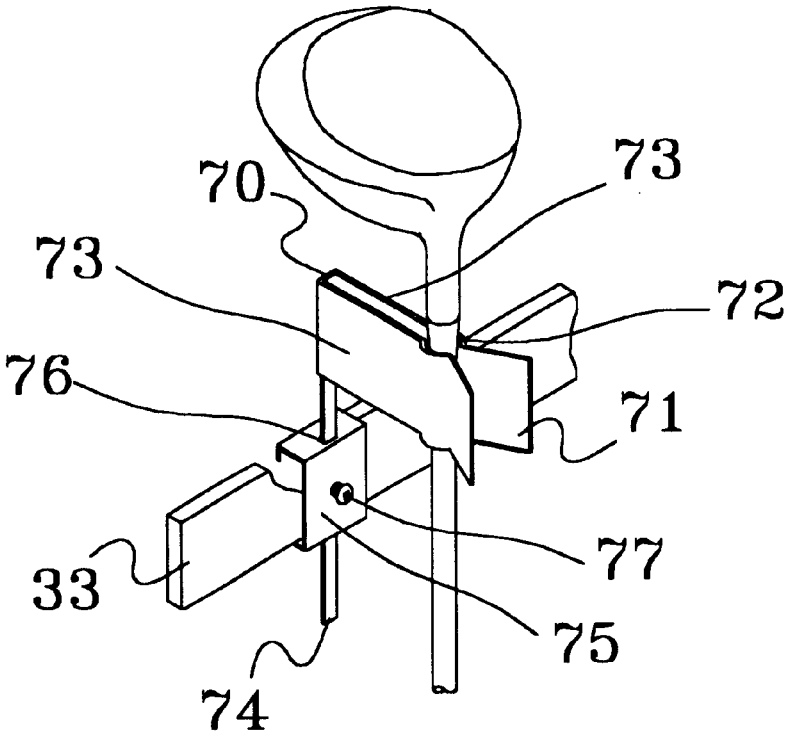
FIG. 14 illustrates the fourth example of the golf club shaft retaining means which clamps the golf club shaft between the two arms of the leaf spring.

Referring to FIG. 14, this particular embodiment of the golf club shaft retaining means 70 has a "U" shape. Each spring arm 73 of golf club shaft retaining means 70 has a ramp 71 at the open end and a concave 72 adjacent to ramp 71 to accommodate the golf club shaft. Generally the distance across concave 72 on each arm 73 is smaller than the diameter of the golf club shaft. The material of golf club shaft retaining means 70 is an elastic material to create spring force. When a golf club shaft is pushed between ramps 71, both arms 73 are forced open. After the shaft passes the narrowest opening at the end of ramp 71 the shaft enters concave 72 and is clamped by two spring arms 73 and the position is secured. Golf club shaft retaining means 70 has a height adjusting column 74. Height adjusting column 74 is inserted into cutout 76 of position setting channel 75 which is coupled with guide rail 33. The horizontal and vertical positions of golf club shaft retaining means 70 are adjusted and set with a set screw 77.

The ramps 71 which open spring arms 73 can be replaced with a pair of rollers to reduce the friction. The spring force to clamp the golf club shaft is leaf spring force in this particular example. Torsion spring with a fulcrum such as a paper clip is also a possibility.

Figure 15:
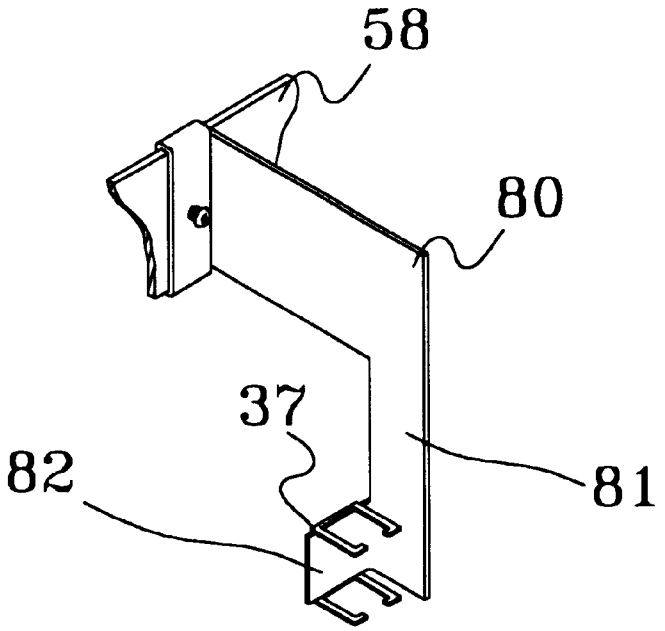
FIG. 15 illustrates the third example of the golf club head retaining means to which a bracket of the golf club shaft retaining means can be installed.

Referring to FIG. 15, this modified space divider 80 is the same idea as space divider 41 except for plate extension 81 and a flange 82 on which golf club shaft retaining means bracket 37 is installed. The golf club shaft retaining means guide rail is not required when space divider 80 is used.

Figure 16:
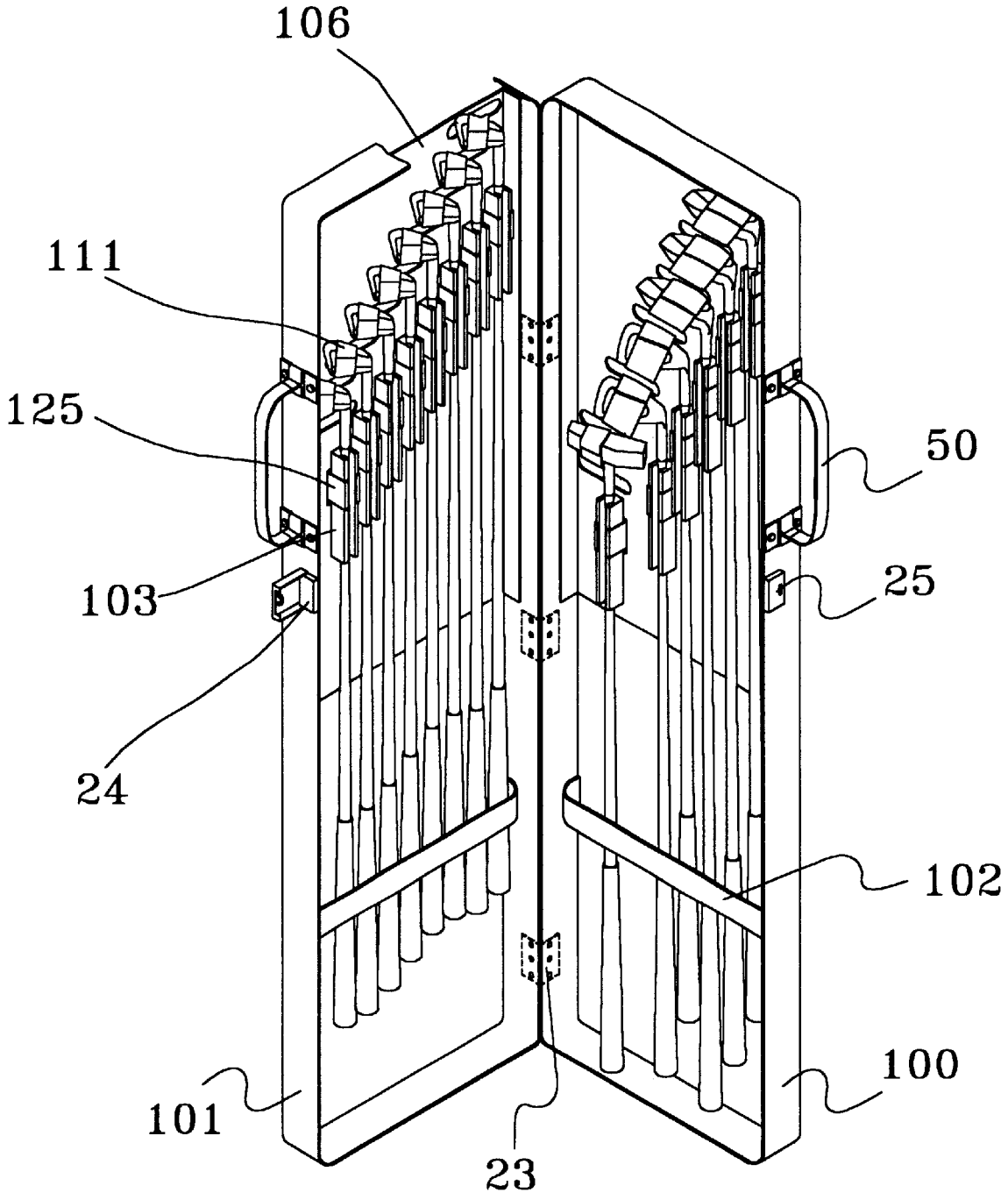
FIG. 16 illustrates the second example of a golf club carrying rack with two symmetrical frames joined with hinges and with cloth strips as the golf head retaining means.
Figure 17:
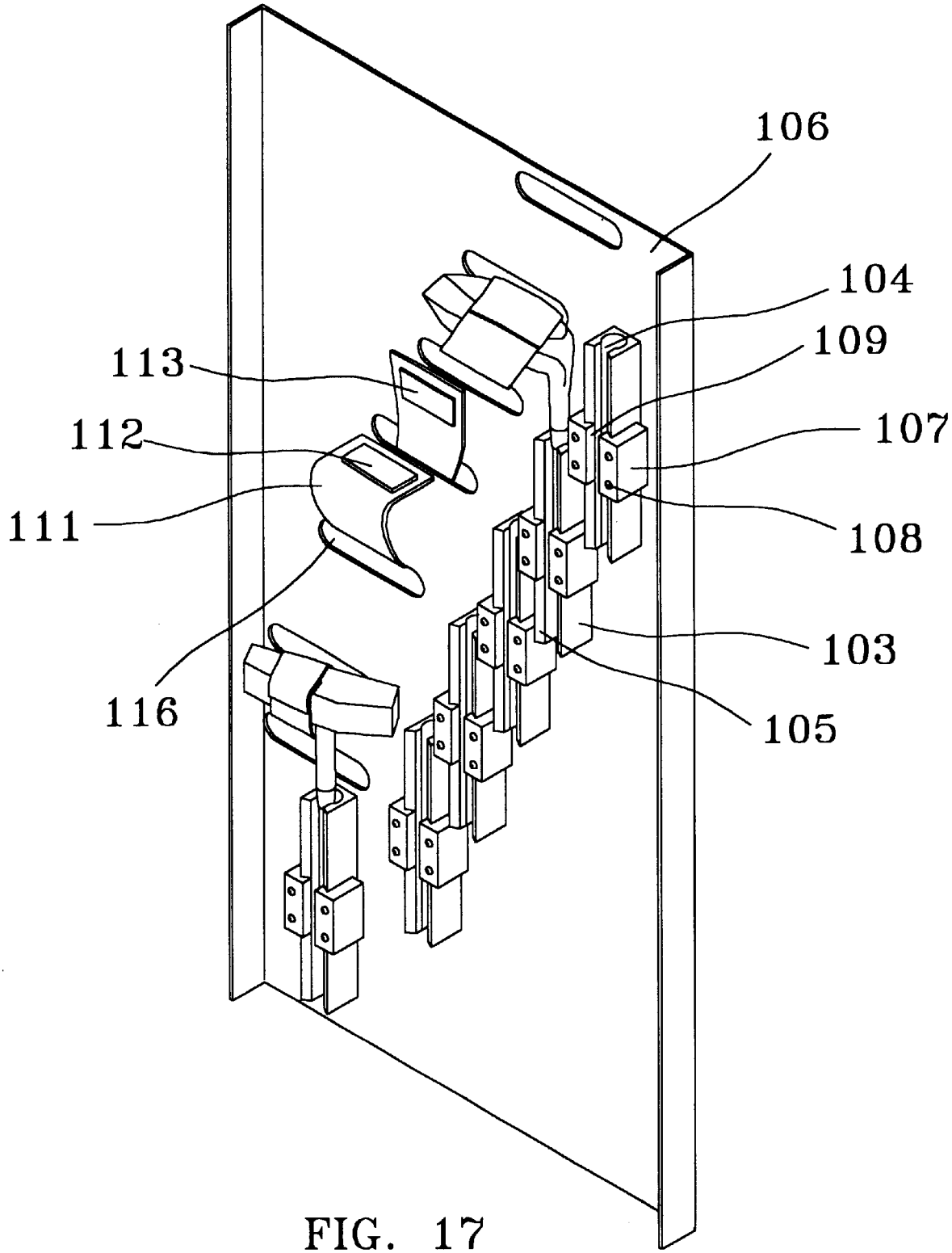
FIGS. 17 and 18 illustrate front and back views respectively of the installation of the fourth example of the golf club head retaining means of cloth strips and the fifth example of the golf club shaft retaining means.
Figure 18:
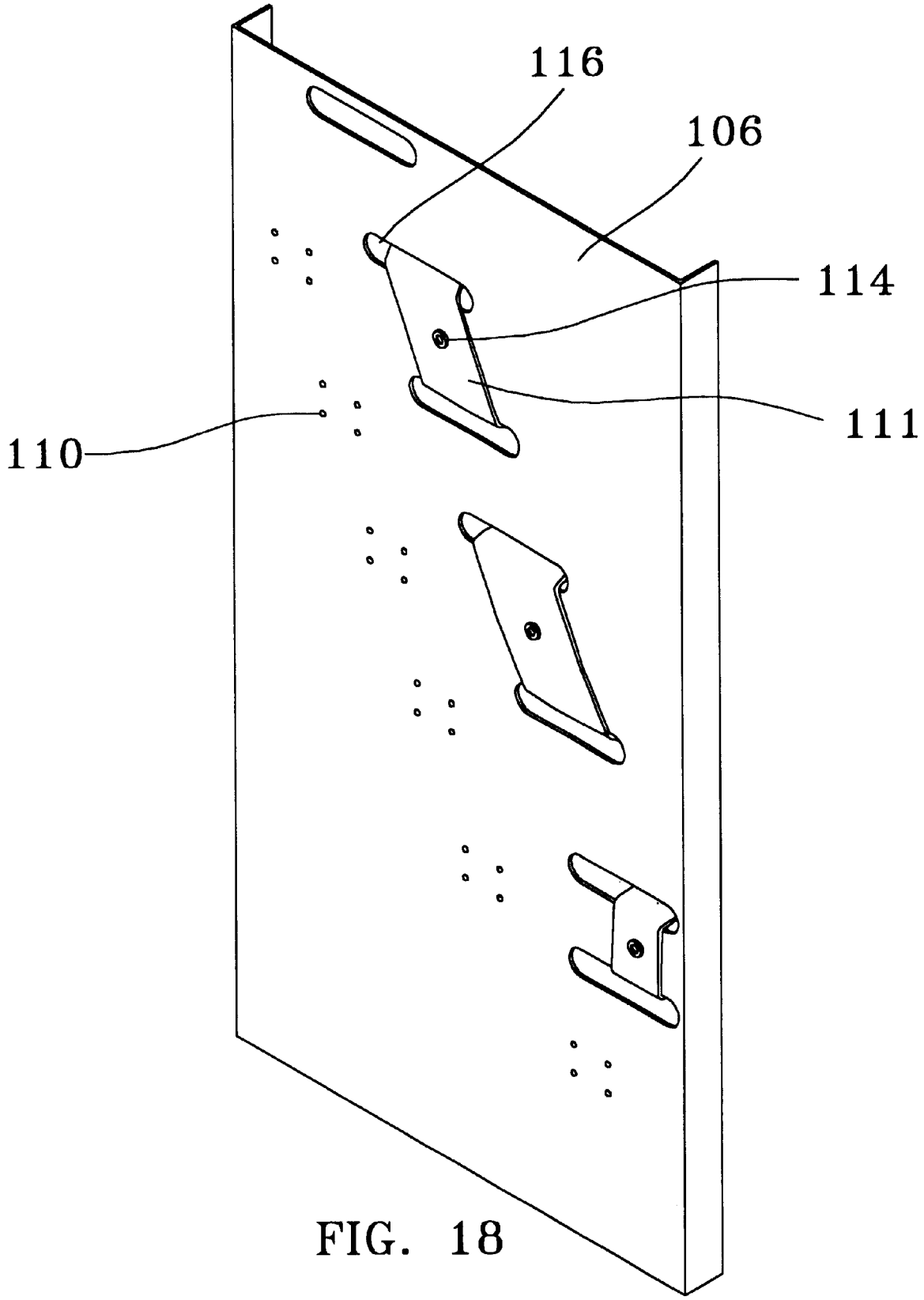

Referring to FIGS. 16, 17 and 18, this particular embodiment is similar to that shown in FIG. 1 except that the golf club head retaining means is a cloth strip which laps over the golf club head, top access caps are not present and the golf clubs are arranged with minimum space between the golf club shafts to minimize the horizontal width of the frame. Two generally symmetrical frames 100 and 101 are joined by hinges 23. The frames are opened to access the golf clubs and are closed and locked with locks 24 and 25. Horizontal flat bar 102 reinforces the frame 100 or 101 and stops the grip end of club shaft from moving forward.

Golf shaft retaining means 103 is held in position on base plate 106 with a pair of L-shaped holders 107. Golf club shaft retaining means 103 is the same as golf club shaft retaining means 34 in FIG. 1 except that front face 105 beside shaft passage slit 104 slopes inward towards the shaft passage slit 104. L-shaped holder 107 is installed on base plate 106 by screw 108. The angle of the inside corner of L-shaped holder 107 is less than 90 degrees and it is the same angle as the outside corner at front face 105 of golf club retaining means 103. When the inside corner of L-shaped holder 107 is coupled with front face 105 of golf club shaft retaining means 103, shaft passage plane 109 of L-shaped holder 107 is flush with the edge of shaft passage slit 104.

Golf club head retaining means 111 is a strip of cloth or leather attached in back of base plate 106 with a snap 114. Both ends of golf club retaining means 111 come out to the front of base plate 106 through horizontal slot 116. Adjusting horizontal position of golf club shaft retaining means 103 so that the golf club head is positioned between two horizontal slots 116 then screws 108 are tightened. A pair of L-shape holders 107 press golf club shaft retaining means 103 to base plate 106 and the vertical position of golf club shaft retaining means 103 is fixed. Then golf club head is lapped with golf club head retaining means 111 ends of which are fastened with Velcro 112 and 113. The golf club head upward movement and rotation around golf club shaft axis are restricted now. Threaded holes 110 for screw 108 are shown in FIG. 18

Figure 19:
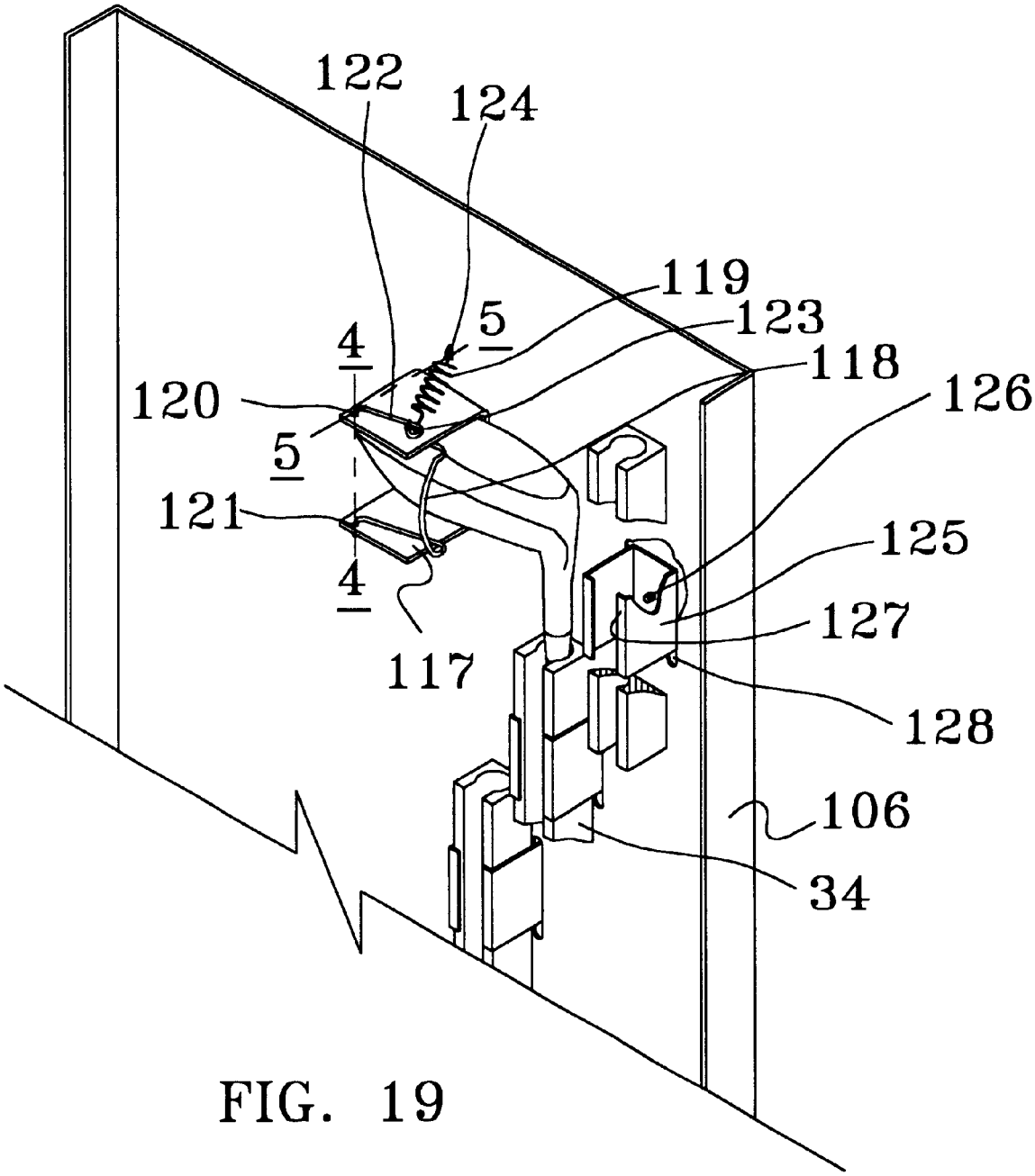
FIG. 19 illustrates the fifth example of the golf club head retaining means with a snap action holder with a spring and another type of bracket for the golf club shaft retaining means.

FIG. 19 illustrates another alternative of the golf club head retaining means and the bracket to hold the golf club shaft retaining means. The golf club head retaining means consists of a C-shaped body 117, a club head holder 118 and a spring 119. Club head holder 118 is made of steel wire which is rectangular shape with an arch to accommodate and hold down the golf club head located inside C-shaped body 117. The lower end of the wire is inserted in a hole 121. The part of wire on the other side of arch goes through another hole 120 of C-shaped body 117 and the rest of wire is bent to shape arm 122 and spring hook ring 123. Club head holder 118 with arm 122 rotates around axis 4—4 which goes through the center of holes 120 and 121. Spring 119 is hooked between spring hook ring 123 at the end of head holder 118 and spring hook ring 124 on base plate 106. Looking from the top of axis 4—4, spring action shown in FIG. 19 creates counter clockwise torque to hold the golf club head in C-shaped body 117 toward base plate 106. Looking from the top of axis 4—4, when club head holder 118 is turned clockwise and the center of spring hook ring 123 passes the line 5—5, the torque created by spring 119 is now clockwise. Therefore club head holder 118 stays open on the opposite side of the line 5—5 with snap action. Club head holder 118 in this embodiment is made of wire. Another alternative may utilize a club head holding plate and an arm to create snap action which are welded on a shaft which goes through holes 120 and 121. Similarly latch-unlatch mechanism can be used instead of spring 119 to hold golf club head holder in position.

Bracket 125 is similar to bracket 37 in FIG. 1. Bracket 125 is a rectangular tube with slightly larger inside dimensions than the sidewise cross section of golf club shaft retaining means 34. There is an opening for the golf club shaft passage at the front. Bracket 125 is inserted through vertical slot 128 in base plate 106 from behind. Golf club retaining means 34 is inserted between edges 127 at the front opening and base plate 106. After adjusting the height of golf club shaft retaining means 34, set screw 126 is tightened into the base plate 106. Instead of the bracket 37 in FIG. 1, modified bracket 125 can be used adding a slot at each side in which guide rail 33 is inserted.

Figure 20:
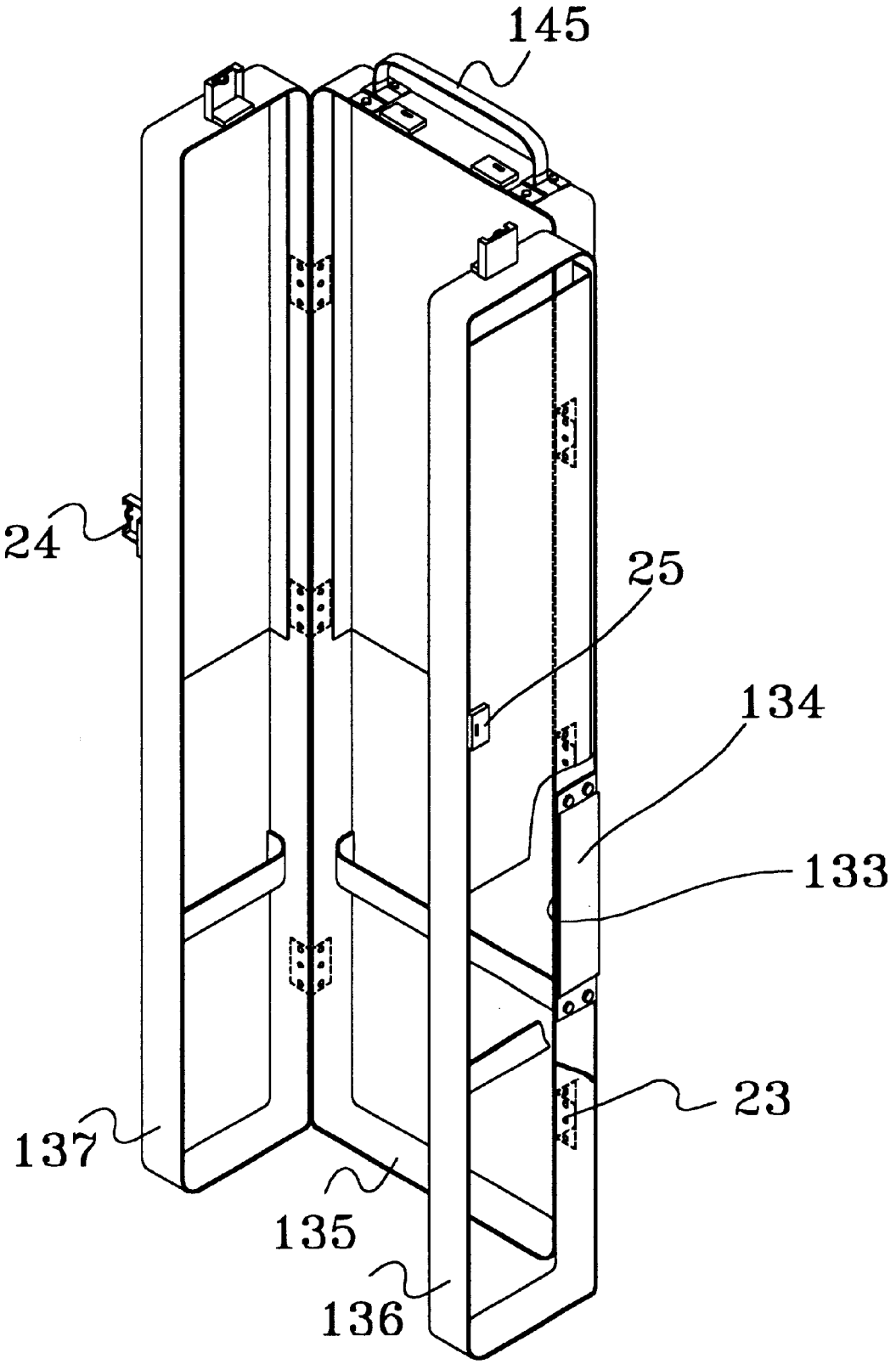
FIG. 20 illustrates the third example of the golf club carrying rack with three frames joined with hinges.
Figure 22:
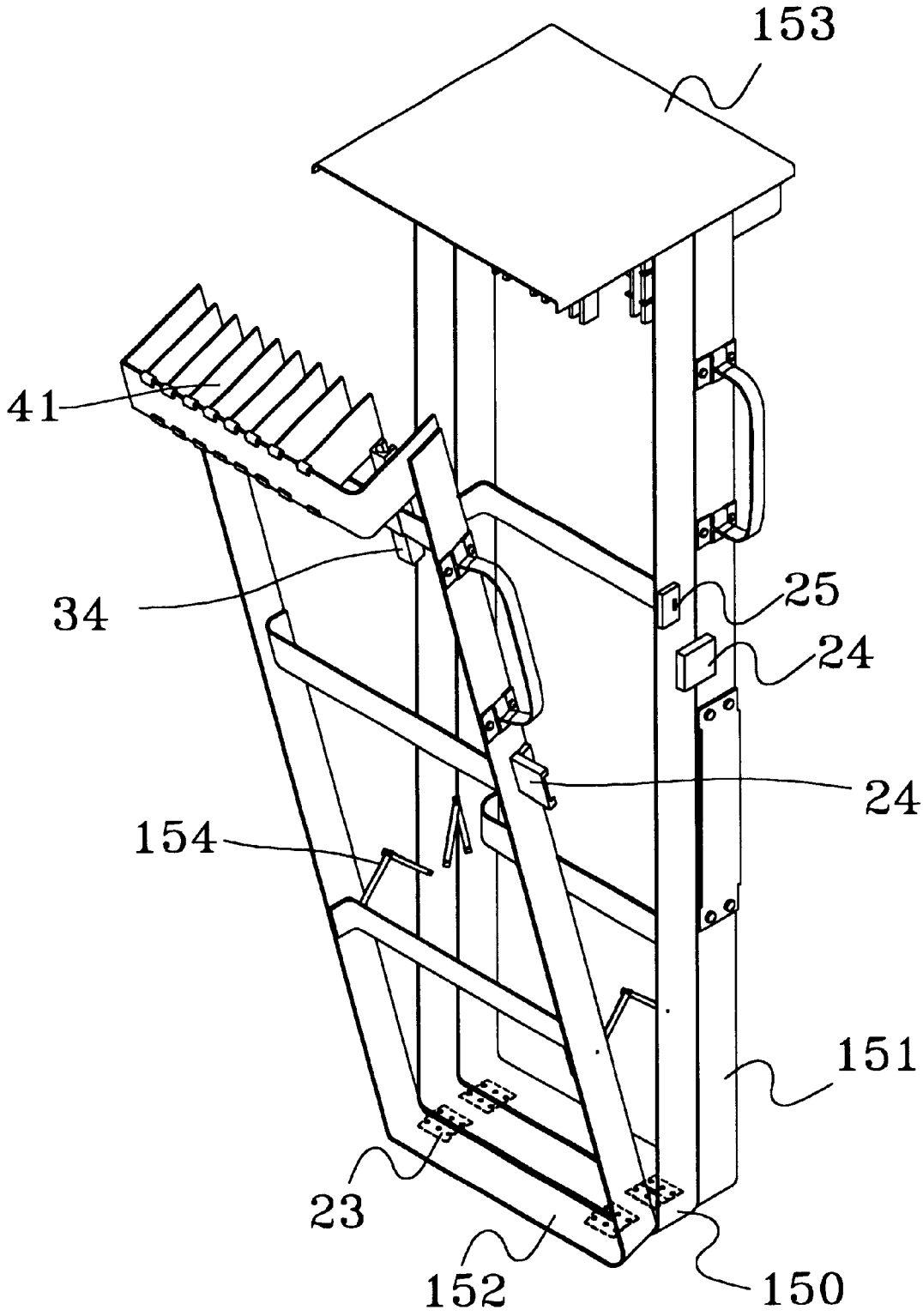
FIG. 22 illustrates the fifth example of the golf club carrying rack with a cap frame between main frames.
Figure 23:
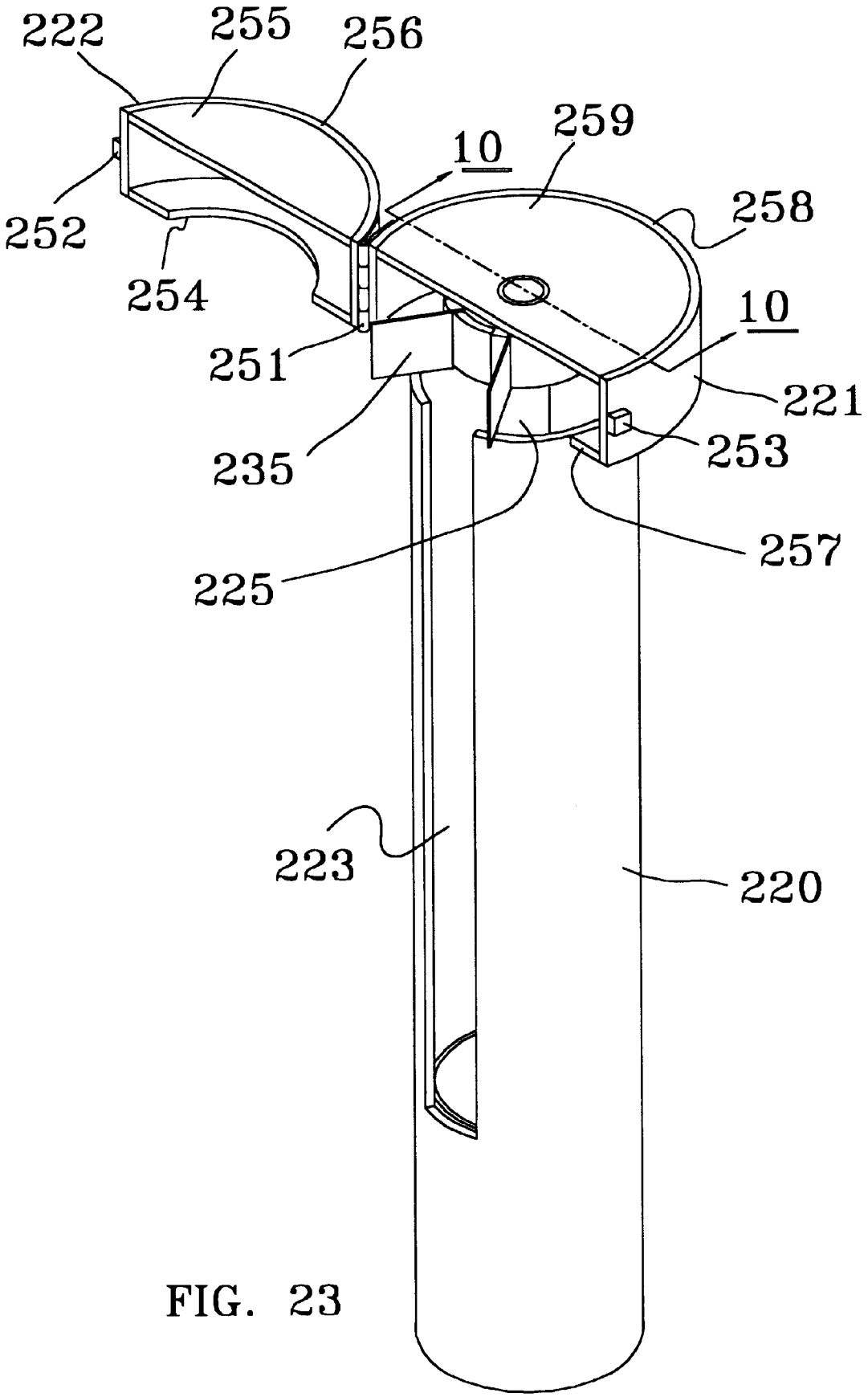
FIG. 23 is a perspective view of a cylindrical housing with a revolving golf club rack.

FIGS. 20, 21 and 22 illustrate other examples of frames. Referring to FIG. 20, the over all frame unit consist of a main frame 135 and door frames 136 and 137. Generally door frames 136 and 137 are symmetrical; the same height and half the width of main frame 135. The door frames 136 and 137 are joined to the main frame 135 with hinges 23 so that the door frames 136 and 137 can be swung open to access the golf clubs and can be secured with locks 24 and 25 when closed.

FIG. 21 illustrates main frame 135 which has a pair of wheels 141(141 is not part of this invention.). Wheel leg 142(142 is not part of this invention.) is installed at the side of main frame 135 with a pair of wheel brackets 134. Carrying rack pull handle 145 is installed at the top. Thus, the rack is converted into a golf cart. Wheel leg 142 is a simple flat plate bent to make the wheel span wider than the width of main frame 135. Both wheels are parallel and at right angles to the ground. Wheel leg 142 is attached to main frame 135 by inserting it into the slit or space 133 which is created between bracket 134 and main frame 135. Bracket 134 can be also used to install a golf cart using an appropriate adapter.

Referring to FIG. 22, this example of the golf club carrying rack consists of a cap frame 150 and two main frames 151 and 152. Cap frame 150 has a cap 153 at the top. Cap frame 150 is between main frames 151 and 152 and is joined to them with hinges 23. The purpose of cap 153 is to restrict the upward movement of the golf clubs. When the golf club carrying rack is carried both main frames 151 and 152 are closed and locked with locks 24 and 25. Open limit mechanism 154 is attached on each side of the two main frames 151 and 152 to cap frame 150. When main frame 152 is unlocked and pulled out clear of cap 153, all golf clubs contained in main frame 152 are exposed and any club is accessible. When a golf club in main frame 151 is required, main frame 152 and cap frame 150 are locked. Main frame 151 is unlocked and pull out clear of cap 153.

Referring to FIGS. 23, 24, 25, 26, 27 and 28, this particular embodiment is for the golf club carrying rack with a cylindrical housing and a rotating rack. The cylindrical housing consists of a top housing 221 to protect the golf club head and a lower housing 220 to protect the golf club shaft. Top housing 221 consists of a top housing wall 258, a top housing cover 259, an access door 222 and locks 252 and 253. Access door 222 consists of a door top cover 255, a door wall 256 and a door bottom plate 254. Door top plate 255 and top housing cover 259 have the same outside radius. Door bottom plate 254 and lower housing flange 257 have the same internal radius. Top housing wall 258 and door wall 256 have the same radius. Door bottom plate 254 and lower housing flange 257 are crescent shaped. The internal radius of door bottom plate 254 and lower housing flange 257 is the same as the outside radius of lower housing 220. Access door 222 is attached to housing 221 with hinge 251. When door 222 is closed and locked, top housing 221 and access door 222 make a complete cylindrical housing. Lower housing 220 and top housing 221 are bonded with lower housing flange 257. Lower housing 220 has golf club access opening 223 and lower housing bottom cover 250. Top housing cover 259 and lower housing bottom cover 250 work as the bearing for shaft 225 to which space divider 235 and golf club shaft retaining means 229 are installed.

Figure 25:
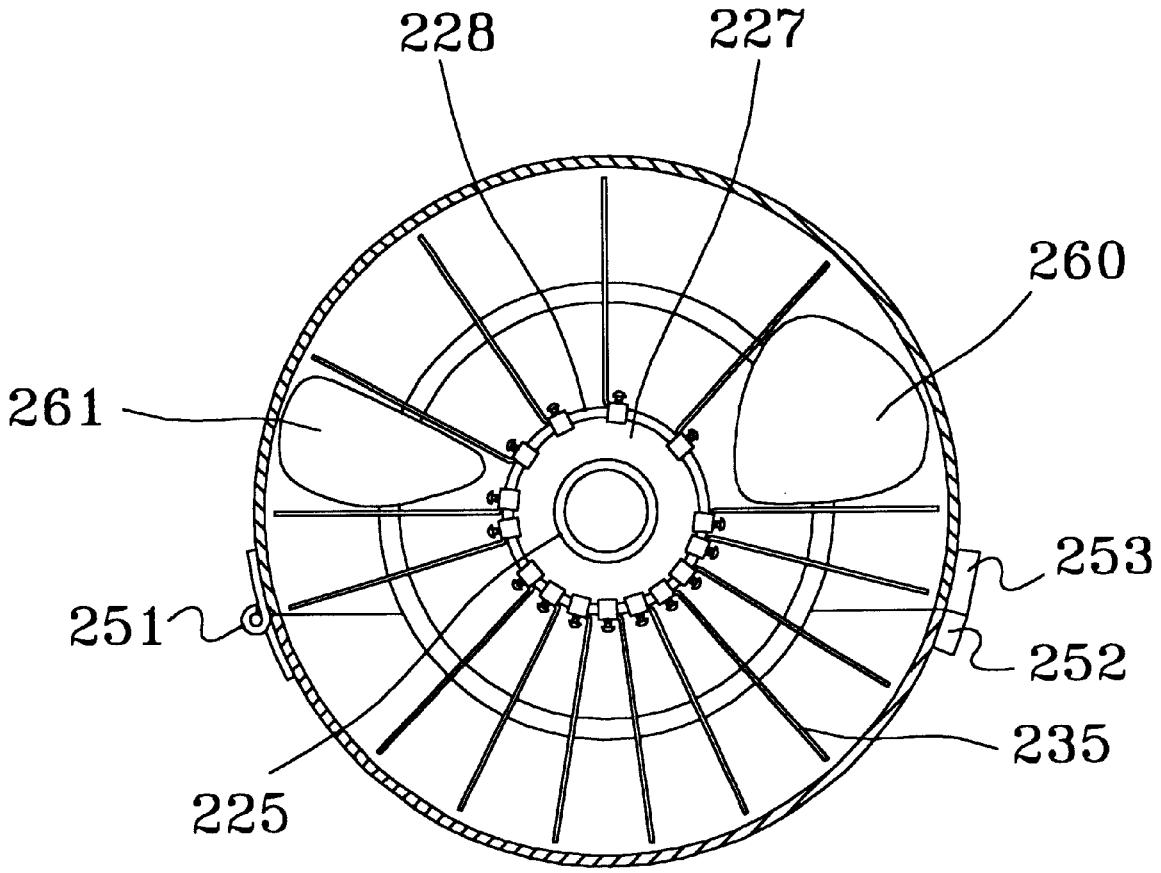
FIG. 25 is a sectional view 12—12 of the cylindrical golf club carrying rack shown in FIG. 26.
Figure 26:
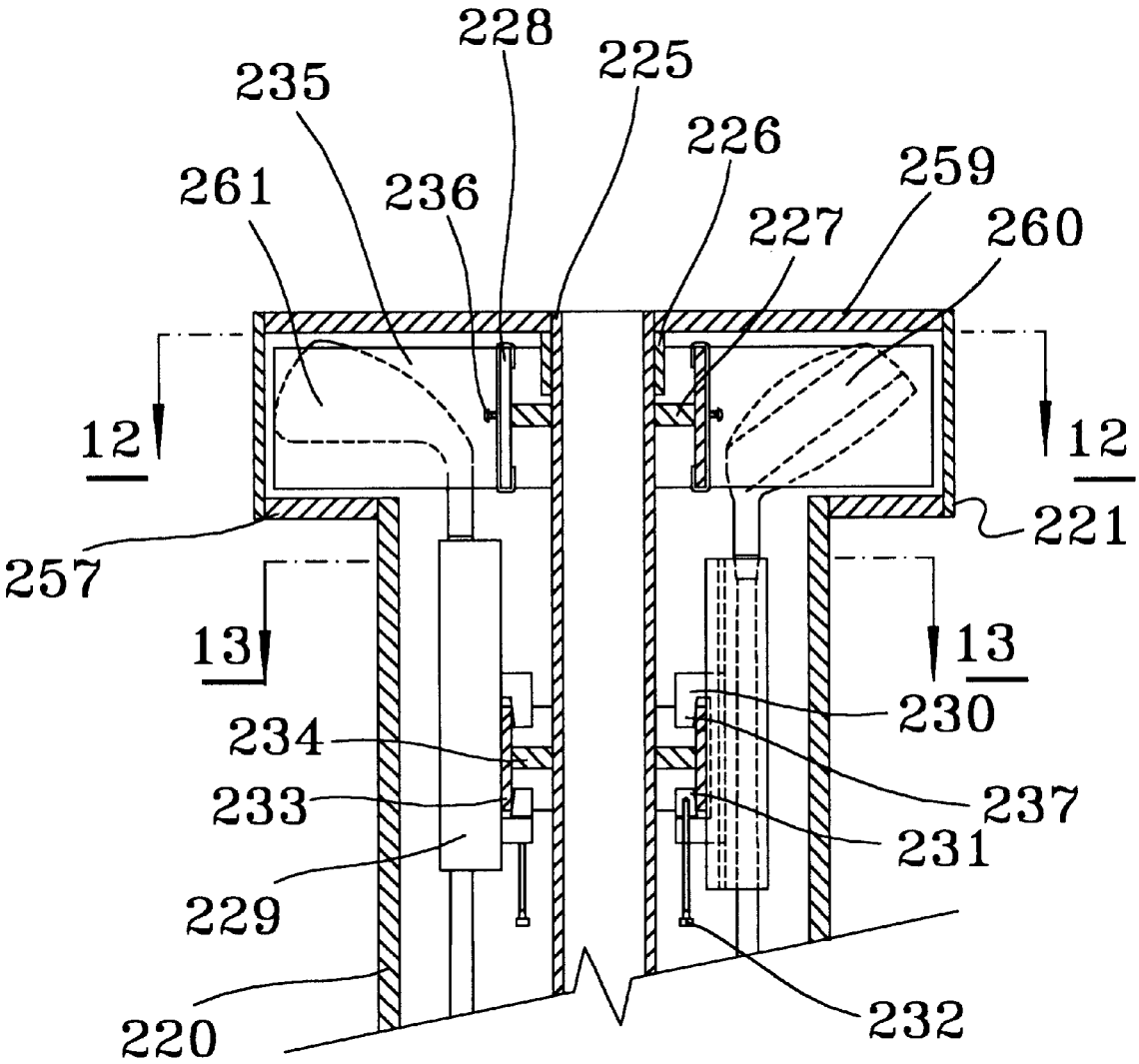
FIG. 26 is an enlarged top portion of FIG. 24.
Figure 27:
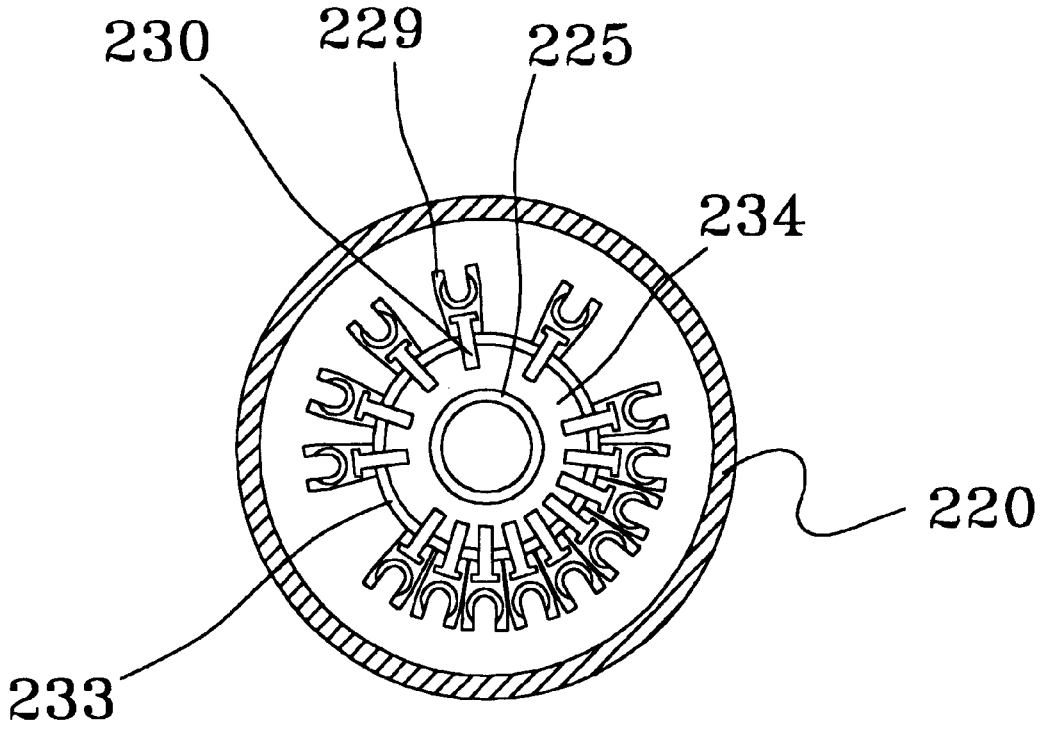
FIG. 27 is a sectional view 13—13 of the cylindrical golf club carrying rack shown in FIG. 26.

FIGS. 25, 26 and 27 illustrate the golf club head retaining means and the golf club shaft retaining means. The basic idea of the golf club retaining means is the same as the embodiment shown in FIG. 1. The golf club head retaining means is created by space divider 235, door top plate 255 and top housing cover 259. Space divider 235 also has a C-shaped channel as space divider 41 mentioned previously. Space divider guide rail 228 is a circular ring installed on shaft 225 by means of guide rail support 227. The C-shaped channel of space divider 235 is coupled with and can slide along space divider guide rail 228.

Golf club shaft retaining means 229 is the same as golf club shaft retaining means 34 illustrated in FIG. 1 except for a T-shaped sidewise cross section groove at the back. Since the extension of the side plane of golf club shaft retaining means 229 passes the center of shaft 225, the side plane of golf club retaining means 299 is perpendicular to shaft retaining means guide rail 233. Shaft retaining means guide rail 233 is a circular ring installed on shaft 225 by means of shaft retaining means guide rail support 234. Golf club shaft retaining means 229 is installed by a C clamp 230. The back side of C clamp 230 has a T-shaped tongue which is coupled with the T-shaped groove of golf club shaft retaining means 229. After assembling C clamp 230 and golf club shaft retaining means 229 by fitting the T-shaped tongue into the T-shaped groove, C clamp 230 is coupled with shaft retaining guide rail 233. At the top of the C clamp 230 opening, there is a flange with a slope extension 237. At the bottom of the C clamp 230 opening, there is a flange with screw 232. Capped on the top of the screw 232 is wedge piece 23 1. Wedge piece 231 has a hole at the bottom; the hole diameter is slightly larger than the outside diameter of screw 232. The wedge piece 231 has a sloped plane which touches the inside edge of shaft retaining means guide rail 233. When the screw 232 is turned, wedge piece 231 moves toward the center of C clamp 230. Golf club shaft retaining means 229 is pulled toward the center of shaft retaining means guide rail 233 by the wedge force created by sloped extension 237 and wedge piece 231. Screw 232 is tightened until golf club shaft retaining means 229 is pressed to shaft retaining means guide rail 233. The position is fixed.

How to fix the golf club head in position is the same as mentioned for the embodiment illustrated in FIG. 1. First let the golf club face touch one of space dividers 235 which is fixed in position. Then the height of golf club shaft retaining means 229 is raised until the top of the golf club head touches door top plate 255. Tighten the shaft retaining means set screw 232. This adjustment restricts the upwards movement of the golf club along the golf club shaft axis. Then another space divider 235 is adjusted so that the space divider 235 touches the opposite side of the golf club head. Tighten set screw 236. This adjustment restricts the rotation of the golf club around the golf club shaft.

Figure 24:
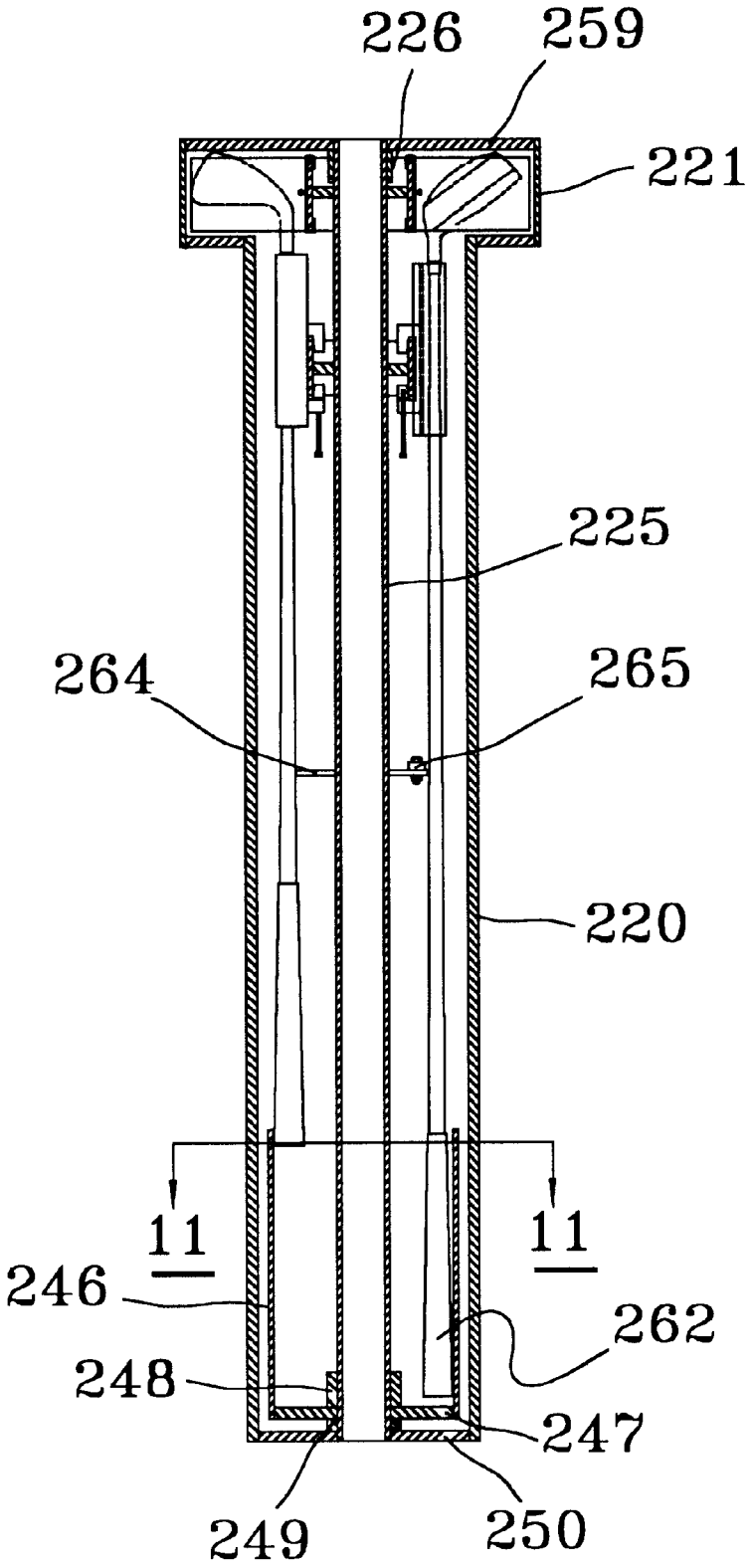
FIG. 24 is a sectional view 10—10 of the cylindrical golf club carrying rack shown in FIG. 23.
Figure 28:
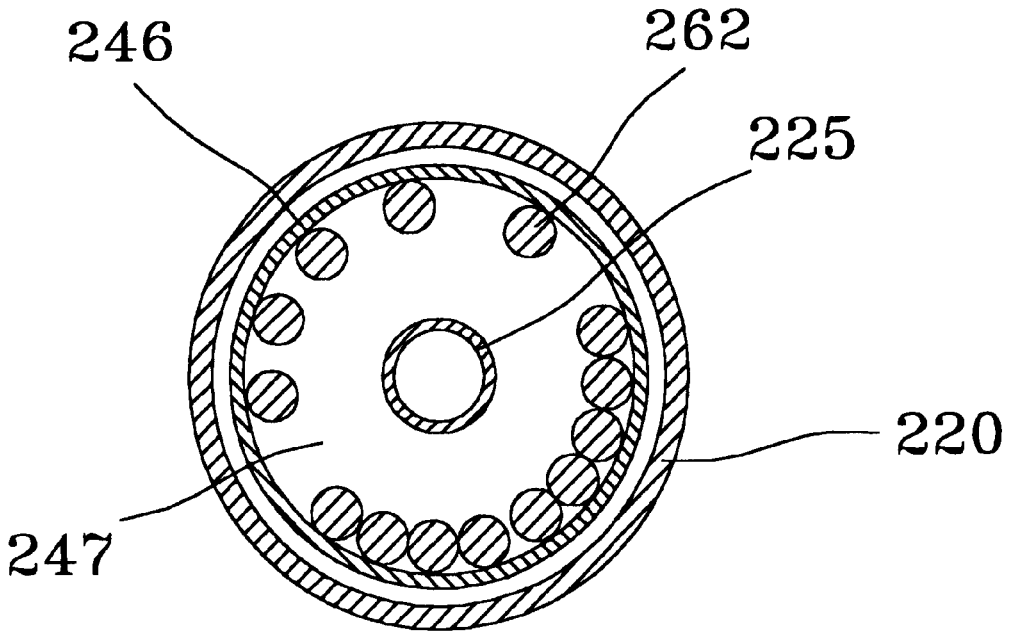
FIG. 28 is a sectional view 11—11 of the cylindrical golf club carrying rack shown in FIG. 24.

Referring to FIGS. 24 and 28, when the golf clubs are laid out in the rack the golf club grips 262(262 is not part of this invention) are inserted in grip holding drum 246. Grip holding drum 246 is a cylindrical drum attached to shaft 225 with grip drum support 247. Spacer 249 maintains the separation between grip drum support 247 and lower housing bottom cover 250. Shaft 225 is inserted into the hole at the center of lower housing bottom cover 250 and the hole at the center of the arc of top housing cover 259. Shaft 225 position is stabilized with a top stopper 226 and a bottom stopper 248 attached to it. Lower housing bottom cover 250 and top housing cover 259 work as the bearing for shaft 225. All the golf clubs revolve and each chosen is taken through access opening 223. A counter weight 265 is installed on counter weight plate 264 which is attached to shaft 225. The golf clubs are not laid out with evenly because the size of head is different. The driver head 260(260 is not part of this invention) is bigger than the iron head 261(261 is not part of this invention) as shown in FIG. 24. Thus, the rack loaded with golf clubs would be out of weight balance. A proper size of counter weight 265 with a proper position on counter weight plate 264 would produce a balanced rack which would rotate smoothly.

This rotating rack can be driven by a motor installed in the cylindrical housing with forward, off and reverse switch.

The parts of the golf club carrying equipment with a cylindrical housing and a rotating rack can be made by plastic molding to reduce the number of parts mentioned above.

The embodiments of the invention in which an exclusive property of privolege is claimed are defined as follow:

1. A golf carrying rack unit comprising:

a) a frame structure having at least one main frame or housing;

b) at least one first guide rail positioned on said frame for installing space dividing means;

c) at least one second guide rail positioned on said frame for installing golf club shaft retaining means;

d) a cross bar or a plate installed on said frame for supporting golf club grip end;

e) golf club retaining means including at least one cap to restrict golf club head upward movement;

f) space dividing means comprising a plate having a right angle channel at the end therein, wherein said plate being coupled with and able to slide along said guide and to fix with said guide rail by a set screw;

g) a golf club shaft retaining means comprising a lengthwise block having a lengthwise slit to accommodate a golf club shaft, and wherein said lengthwise block comprising a cylindrical hole, with larger diameter than the width of said lengthwise slit, at the top of said block; and h) a bracket comprising a shape and size to receive said golf club shaft retaining means, said bracket further comprising a golf club shaft passage at the front end of said bracket, and positioned fixing means comprising a set screw for fixing said bracket to said second guide rail.

2. The golf club carrying rack unit in claim 1 wherein the frame structure comprising two hinged frames, each of which comprises said at least one first guide rail for the space dividing means, said at least one second guide rail for the golf club shaft retaining means, said cross bar or a plate to support the golf club grip end, and said cap at the top of the rack unit.

* * * * *